US011246335B2

(12) United States Patent
Benning et al.

(10) Patent No.: US 11,246,335 B2
(45) Date of Patent: Feb. 15, 2022

(54) MATERIAL FOR INCLUSION IN A SMOKING ARTICLE

(71) Applicant: British American Tobacco (Investments) Limited, London (GB)

(72) Inventors: Jocelyn Benning, London (GB); Edward Dennis John, London (GB); Samuel Paul Whiffen, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 649 days.

(21) Appl. No.: 14/904,567

(22) PCT Filed: Jul. 11, 2014

(86) PCT No.: PCT/GB2014/052132
§ 371 (c)(1),
(2) Date: Jan. 12, 2016

(87) PCT Pub. No.: WO2015/004483
PCT Pub. Date: Jan. 15, 2015

(65) Prior Publication Data

US 2016/0219926 A1 Aug. 4, 2016

(30) Foreign Application Priority Data

Jul. 12, 2013 (GB) ..... 1312501

(51) Int. Cl.
*A24B 15/30* (2006.01)
*A24D 1/18* (2006.01)
(Continued)

(52) U.S. Cl.
CPC ..... *A24B 15/303* (2013.01); *A24B 15/285* (2013.01); *A24D 1/002* (2013.01); *A24D 1/18* (2013.01)

(58) Field of Classification Search
None
See application file for complete search history.

(56) References Cited

U.S. PATENT DOCUMENTS 2,928,400 A 6/1954 Touey
3,545,448 A 12/1970 Troon
(Continued)

FOREIGN PATENT DOCUMENTS

CA 1252279 A 4/1989
CN 102499451 A 6/2012
(Continued)

OTHER PUBLICATIONS

International Preliminary Report on Patentability for corresponding application PCT/GB2014052132 filed Jul. 11, 2014 dated Nov. 9, 2015.

(Continued)

*Primary Examiner* — Michael J Felton
*Assistant Examiner* — Katherine A Will
(74) *Attorney, Agent, or Firm* — Cantor Colburn LLP

(57) ABSTRACT

A smokeable material for inclusion in a smoking article, the material comprising particles or fragments comprising acacia gum, wherein the particles or fragments do not comprise a diluent, flavourant or aerosol generating material; and substantially comprise or consist of acacia gum.

22 Claims, 7 Drawing Sheets

(51) Int. Cl.
*A24B 15/28* (2006.01)
*A24D 1/00* (2020.01)

(56) References Cited

U.S. PATENT DOCUMENTS

| | | | | |
|---|---|---|---|---|
| 3,547,695 | A | 12/1970 | Agazarian | |
| 4,889,144 | A * | 12/1989 | Tateno | A24D 3/061 131/331 |
| 4,936,920 | A | 6/1990 | Keritsis et al. | |
| 4,967,773 | A | 11/1990 | Shaw | |
| 5,065,776 | A | 11/1991 | Lawson et al. | |
| 2006/0275344 | A1 | 12/2006 | Mody | |
| 2015/0114405 | A1 * | 4/2015 | Rasouli | A24D 1/00 131/290 |

FOREIGN PATENT DOCUMENTS

| | | | |
|---|---|---|---|
| CN | 102920013 | A | 2/2013 |
| EP | 0150077 | A2 | 7/1985 |
| EP | 0934703 | A1 | 8/1999 |
| EP | 1614360 | A1 | 1/2006 |
| GB | 910451 | | 11/1962 |
| NO | 2006061117 | A1 | 6/2006 |
| NO | 2007083245 | A2 | 7/2007 |
| NO | 2010125385 | A1 | 11/2010 |
| NO | 2010125386 | A1 | 11/2010 |
| NO | 2011033121 | A1 | 3/2011 |
| NO | 2011042211 | A1 | 4/2011 |
| NO | 2011045609 | A1 | 4/2011 |
| WO | 2013152852 | A1 | 10/2013 |

OTHER PUBLICATIONS

International Search Report for corresponding application PCT/GB2014052132 filed Jul. 11, 2014; dated Oct. 21, 2014.
Written Opinion for corresponding application PCT/GB2014052132 filed Jul. 11, 2014; dated Oct. 21, 2014.

* cited by examiner

| Cigarette | Pressure Drop (mm W.G.) | Filler Weight (g) | Firmness (%) | Tip Ventilation (%) |
|---|---|---|---|---|
| Control | 135 | 0.586 | 75.6 | 0 |
| Test | 164 | 0.741 | 78.0 | 0 |

| Smoking Regime No. | Puff Volume (mL) | Puff Duration (s) | Puff Frequency (s) | Ventilation |
|---|---|---|---|---|
| 1 | 55 | 2 | 30 | Closed (non tip ventilated cigarette) |
| 2 | 35 | 2 | 60 | Closed (non tip ventilated cigarette) |

Figure 5

| Analyte | % change compared to control |
|---|---|
| Ammonia | -30.99 |
| 1-Aminonaphthalene | -32.49 |
| 2-Aminonaphthalene | -35.31 |
| 3-Aminobiphenyl | -27.25 |
| 4-Aminobiphenyl | -30.45 |
| Hydrogen Cyanide | -30.82 |
| Catechol | -0.30 |
| Hydroquinone | -9.16 |
| m-Cresol | -19.86 |
| o-Cresol | -31.07 |
| p-Cresol | -32.24 |
| Phenol | -36.25 |
| Pyridine | -13.74 |
| Quinoline | -28.12 |
| Styrene | -1.92 |
| NAB | -20.32 |
| NAT | -20.20 |
| NNK | -8.96 |
| NNN | -21.96 |
| 1,3-Butadiene | -2.77 |
| Acrylonitrile | -16.46 |
| Benzene | -5.77 |
| Isoprene | -16.93 |
| Toluene | -2.22 |
| Mercury | -13.16 |
| Cadmium | -17.94 |
| CO | -5.07 |
| NFDPM | -12.10 |
| Nicotine | -8.86 |

Figure 7

| Analyte | % change compared to control |
|---|---|
| Ammonia | -28.25 |
| 1-Aminonaphthalene | -39.94 |
| 2-Aminonaphthalene | -41.59 |
| 3-Aminobiphenyl | -35.29 |
| 4-Aminobiphenyl | -37.12 |
| Hydrogen Cyanide | -33.85 |
| Nitric Oxide | -7.29 |
| m-Cresol | -12.12 |
| o-Cresol | -26.88 |
| p-Cresol | -29.70 |
| Phenol | -34.66 |
| Pyridine | -28.15 |
| Quinoline | -24.87 |
| Styrene | -18.34 |
| NAB | -15.10 |
| NAT | -16.86 |
| NNK | -17.21 |
| NNN | -18.82 |
| 1,3-Butadiene | -1.80 |
| Acrylonitrile | -6.02 |
| Isoprene | -14.49 |
| CO | -1.68 |
| NFDPM | -8.93 |
| Nicotine | -11.76 |

Figure 8

| Cigarette | Pressure Drop (mm W.G.) | Filler Weight (g) | Firmness (%) | Tip Ventilation (%) |
|---|---|---|---|---|
| Control | 135 | 0.586 | 75.6 | 0 |
| Test | 156 | 0.750 | 81.3 | 0 |

| Analyte | % change compared to control |
|---|---|
| NAB | -28.07 |
| NAT | -21.77 |
| NNK | -24.12 |
| NNN | -21.10 |
| CO | 8.26 |
| NFDPM | 2.77 |
| Nicotine | -10.22 |

| Analyte | % change compared to control |
|---|---|
| NAB | -21.47 |
| NAT | -20.07 |
| NNK | -19.95 |
| NNN | -17.84 |
| CO | 1.12 |
| NFDPM | -8.55 |
| Nicotine | -10.29 |

MATERIAL FOR INCLUSION IN A SMOKING ARTICLE

TECHNICAL FIELD

The invention relates to a smokeable material for inclusion in a smoking article, the material comprising particles or fragments comprising acacia gum.

BACKGROUND

The use of acacia gum in combustible products is known for purposes such as encapsulation of flavourants or diluents, use as a binder, or to form coatings on paper such as the wrapper of a smoking article.

SUMMARY

In accordance with a first aspect of the present invention there is provided a smokeable material for inclusion in a smoking article, the material comprising particles or fragments comprising acacia gum, wherein the particles or fragments do not comprise a diluent, flavourant or aerosol generating material.

In some embodiments, the particles or fragments substantially comprise, or consist of acacia gum.

In some embodiments, the particles or fragments further comprise a coating, which may be a calcium alginate coating.

In some embodiments, the particles or fragments are formed prior to their application to or incorporation into other components of the smokeable material.

In some embodiments, the particles or fragments are formed upon, or subsequent to application to or incorporation into other components of the smokeable material.

In some embodiments, the smokeable material comprises tobacco.

In some embodiments, the smokeable material further comprises one or more of tobacco substitutes, filler material, diluents, binders, humectants, flavour or flavourants or aerosol generating material.

In some embodiments, the particles or fragments comprising acacia gum are applied to or incorporated into the smokeable material in an amount between 10 mg and 675 mg per 750 mg smokeable material; between 50 mg and 300 mg per 750 mg smokeable material; or around 150, 160, 170, 180, 190, 200, 210, 220 or 230 mg per 750 mg smokeable material.

According to a second aspect of the present invention, there is provided a smoking article comprising a smokeable material according to the first aspect of the invention.

According to a third aspect of the present invention, there is provided the use of acacia gum in a smoking article to reduce the level of one or more constituents of mainstream smoke generated upon use of the smoking article.

In some embodiments according to the third aspect of the invention, the acacia gum is in the form of particles or fragments.

In some embodiments according to the third aspect of the invention, the acacia gum is located within the tobacco rod, and may be applied to or incorporated into the smokeable material within the tobacco rod.

BRIEF DESCRIPTION OF THE DRAWINGS

Embodiments of the invention will now be described, by way of example only, with reference to the accompanying drawings, in which:

FIG. 5 shows the tabulated data for FIG. 4.

FIG. 7 shows the tabulated data for FIG. 6.

FIG. 8 is a table showing the result of physical analysis of test cigarettes comprising particles of acacia gum coated with calcium alginate, and control cigarettes.

DETAILED DESCRIPTION

Figures 1, 2, 3:
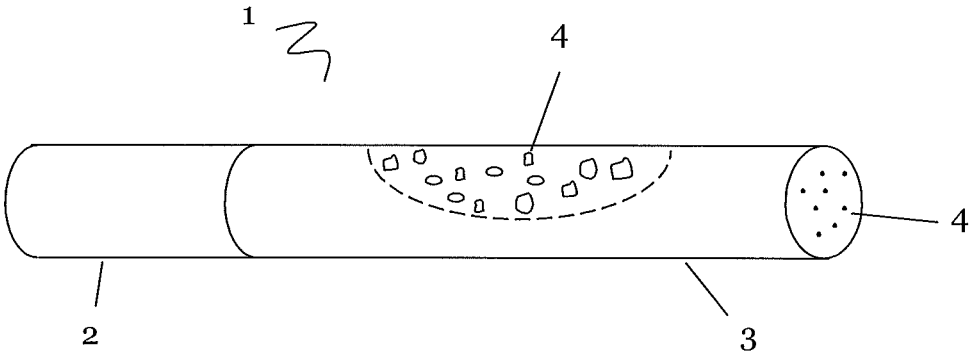
FIG. 1 is a representation of a smoking article in accordance with a second aspect of the present invention.
FIG. 2 is a table showing the result of physical analysis of test cigarettes comprising acacia gum, and control cigarettes.
FIG. 3 provides details of smoking regimes 1 and 2.

Smoke arising from a smoking article which comprises tobacco is a complex, dynamic mixture of more than 5000 identified constituents. The constituents are present in the mainstream smoke (MS), which exits the mouth end of the cigarette, and are also released between puffs as constituents of sidestream smoke (SS).

It can be a research objective to decrease levels of at least some of the constituents of mainstream smoke, such as one or more of aromatic amines; phenols; carbonyls; polycyclic aromatic hydrocarbons; acrylonitrile; volatile hydrocarbons such as toluene, isoprene, styrene and benzene; nitrogen heterocyclics such as pyridine; TSNAs such as N'-nitrosoanabasine (NAB), N'-nitrosoanatabine (NAT), 4-(methylnitrosamino)-1-(3-pyridyl)-1-butanone (NNK) and N'-nitrosonornicotine (NNN); and inorganic compounds such as ammonia, hydrogen cyanide, nitric oxide and carbon monoxide.

Methods for selectively reducing mainstream smoke and/or sidestream smoke constituents may include reducing the levels of certain compounds from the starting material by, for example, using biotechnological methods; blending of different types of tobacco, or treating the tobacco prior to incorporation into the smoking article; reducing the amount of tobacco in the smoking article by including diluents or fillers; ventilation of the smoking article, where ambient air is drawn into the smoking article to dilute the MS; and use of a filter, which enhances the removal of MS constituents. In addition, attempts have been made to selectively remove or reduce constituents from cigarette smoke by incorporating sorbents into the smoking article.

Acacia gum, which is also known as gum Arabic, meska or chaar gund, is made of the sap taken from two species of acacia tree (Acacia seyal and Acacia senegal). Its main component is arabin, which is the calcium salt of the polysaccharide arabic acid.

Acacia gum has a variety of uses. It is frequently included in soft drink syrups and confectionary in the food industry, and is used as a binder and/or emulsifying agent, suspending agent or viscosity increasing agent in certain pharmaceuticals and cosmetics.

Acacia gum has also been used in combustible products for purposes such as encapsulation of, for example, diluents; as a vehicle for, for example, flavourants; use as a binder; and to form coatings on paper such as the wrapper of a smoking article.

It has now been discovered that incorporation of acacia gum into smokeable material for incorporation into a smoking article selectively decreases the level of one or more constituents in the mainstream smoke generated from such articles in use. Furthermore, the observed reductions for several of these constituents were greater than expected by the reduction observed for nicotine-free dry particulate matter (NFDPM).

The term "NFDPM" is a term of the art, determined utilising a test methodology as would be understood by a skilled person. It is defined as the weight of mainstream smoke particulate matter trapped on a high efficiency particulate filter, minus the weight of nicotine and water on the filter. It is usually expressed in weight units of milligrams per cigarette.

Accordingly, in a first aspect of the present invention there is provided a smokeable material for inclusion in a smoking article, the material comprising particles or fragments comprising acacia gum, wherein the particles or fragments do not comprise a diluent, flavourant or aerosol generating material.

In some embodiments, the particles or fragments may substantially comprise, or consist of acacia gum. In particular, the particles or fragments comprising acacia gum may not comprise a diluent, flavour or flavourant, or aerosol generating material.

As used herein, the term 'diluent' means a material which can be used to dilute the smokeable material. Examples include glycerol, solanesol, neophytadiene, 3-methylanisole, eugenol, 1-phenyl-1-pentanone, 2,3-dimethyl-4-ethylacetophenone, nicotinic acid, docosane, dotriacontane, eicosane, neophytadiene, heneicosane, hentriacontane, heptacosane, hexacosane, nonacosane, octacosane, pentacosane, pentatriacontane, squalene, tetracosane, tetratriacontane, triacetin, triacontane, triacosane and tritriacontane. In some embodiments, the particles or fragments comprising acacia gum do not comprise triacetin.

As used herein, the term 'aerosol generating material' means a substance which, when incorporated into a smoking article rapidly creates or promotes an aerosol upon ignition of the article. Examples include polyhydric alcohols, glycerol, propylene glycol, triethylene glycol, triethyl citrate, triacetin, or high boiling point hydrocarbons.

In some instances, the terms 'diluent' and 'aerosol generating material' can be used interchangeably. For example, some substances/materials have the effect of both diluting the smokeable material, and rapidly creating or promoting an aerosol upon incorporation into and ignition of a smoking article. Examples of such materials are triacetin and glycerol.

As used herein, the terms 'flavour' and 'flavourant' refer to materials which, where local regulations permit, may be used to create a desired taste or aroma in a product for adult consumers. Examples of flavours or flavourants include menthol, citrus, vanilla, aniseed, benzaldehyde or acetyladehyde.

In alternative embodiments, the particles or fragments comprising acacia gum may comprise one or more additional components. For example, the particles or fragments may comprise one or more minerals, such as chalk; one or more catalysts; fine particles of tobacco; one or more zeolites; one or more absorbents; or one or more aerogels, cryogels or xerogels. In some embodiments, the one or more catalysts may be one or more stable metallic catalysts such as palladium or molybdenum trioxide. In some embodiments, the one or more zeolites may be one or more hydrophobic zeolites, optionally with a molar ratio of $SiO_2/Al_2O_3$ which is greater than 5.5. In some embodiments, the zeolite may be pentasil type (ZSM-5) or Y-type. In some embodiments, the one or more absorbents may be carbon or silica.

In some embodiments, acacia gum particles or fragments may be formed prior to their application to or incorporation into the other components of the smokeable material (referred herein as "pre-formed particles"/"pre-formed fragments").

Any method suitable for the preparation of granular material can be used to form the pre-formed particles or fragments. For example, pre-formed particles may be created by dissolving acacia gum in water followed by spray drying. The resultant particles may be agglomerated using, for example, a fluidised bed drier.

Alternatively, the particles may be created by mechanical disruption or grinding, freeze drying, crystallization, nucleation or evaporation methods. Such methods would be known to those skilled in the art of particle preparation.

The resultant particles or fragments may then be classified into specific size ranges, by, for example, sequential sieving.

In some embodiments, pre-formed fragments or particles may be between 20 μm and 5 mm in diameter; between 100 μm and 4 mm in diameter; between 0.1 mm and 3.5 mm in diameter; between 0.5 mm and 2 mm in diameter; between 0.6 mm and 1.8 mm in diameter or between 0.7 mm and 1 mm in diameter. In certain embodiments, the particles are around 0.8 mm (800 μm) in diameter.

Pre-formed acacia gum fragments may formed by creating a sheet comprising acacia gum. Any suitable method for making a sheet may be used, for example band casting. The sheet is then cut to approximately the same dimensions as tobacco which is intended for incorporation into a smoking article.

Alternatively, pre-formed acacia gum fragments may be formed by extrusion, for example by extruding acacia gum under pressure, and cutting the extruded gum to a size suitable for incorporation into smokeable material. Extrusion may be carried out using any known extrusion technology, such as single or twin screw extruding apparatus, ram pressure equipment, and/or extrusion through specific dye configurations. As an example, the apparatus and methods disclosed in WO 2006/061117 are suitable, wherein the starting material is heated and placed under pressure, and then guided through a shearing gap and defibrated.

In some embodiments, at least some of the pre-formed particles or fragments comprising or consisting of acacia gum are provided with a coating. The coating may be a complete or a partial coating. In some embodiments, the particles or fragments may be coated with one or more substances that provide a water insoluble and/or protective coating. For example, the particles or fragments may comprise a coating of a gum, such as a gum derived from alginate, such as sodium alginate. The coating may be applied to the acacia gum particles or fragments from a solution, for example by spraying. For example, a solution of sodium alginate in pure (deionized) water may be created and sprayed onto pre-formed particles or fragments comprising or consisting of acacia gum. The resultant particles may be further treated to create cross linkages with the coating, for examples with calcium salts. As an example, treatment of sodium alginate coated acacia gum with calcium chloride solution can result in cross linking of the sodium alginate to produce a calcium alginate coating. Since calcium alginate is insoluble in water, such a coating confers a water insoluble protective coating on the particles and fragments to which it is applied. The coating may be achieved using, for example, a fluidized bed drier.

Pre-formed particles or fragments may be applied to or incorporated into one or more components of a smoking article prior to or during assembly or manufacture of the article. For example, acacia gum particles or fragments may be sprinkled or sprayed onto smokeable material, such as tobacco, prior to incorporation of the smokeable material into a smoking article.

Any suitable method may be used to achieve this aim. For example, application of particles or fragments to smokeable material may be achieved using apparatus that allows objects such as granulate, particulate or powdered material to be added to one or more of the components of a smoking article prior to or during assembly of the article, such as that disclosed in WO 2011/033121. In WO 2011/033121 granulate material is introduced to a hopper, which is connected to a hopper exit tube. The granulate material drops, under gravity, from the hopper into the hopper exit tube from where it becomes entrained by either a venturi device or a vacuum pump, and is inserted into the tobacco rod or tobacco stream. Alternatively, pre-formed particles or fragments may be applied to one or more components of a smoking article using a focussed stream driven by a compressed gas jet, by drawing the particles or fragments across one or more components of a smoking article by the action of vacuum and/or other methods known by a person skilled in the art.

Pre-formed fragments or particles comprising or consisting of acacia gum may be distributed through the smokeable material by, for example, mixing.

In alternative embodiments, acacia gum particles or fragments may be formed upon, or subsequent to application to or incorporation into the other components of the smokeable material. For example, a solution of acacia gum may be formed by mixing powdered acacia gum with water. The solution may then be sprayed onto the smokeable material and the smokeable material dried prior to incorporation into a smoking article. Alternatively, the solution may be injected into a rod of smokeable material once the smoking article has been, or is being assembled. The smoking article may then be dried and conditioned in preparation for use.

The smokeable material to which particles or fragments of acacia gum are applied or with which particles or fragments of acacia gum are incorporated may comprise tobacco.

In some embodiments, the smokeable material further comprises one or more of the components typically found in the tobacco rod of a combustible product such as a smoking article. For example, tobacco substitutes, filler materials, diluents, binders, humectants, flavours or flavourants, and aerosol generating means.

In some embodiments, the particles or fragments comprising acacia gum may be applied to or incorporated into the smokeable material in an amount between 10 mg and 675 mg per 750 mg smokeable material; between 50 mg and 300 mg per 750 mg smokeable material; or around 150, 160, 170, 180, 190, 200, 210, 220 or 230 mg per 750 mg smokeable material.

Smokeable material comprising acacia gum may be incorporated into a smoking article, such as a cigarette. Accordingly, in a second aspect, there is provided a smoking article comprising a smokeable material according to the first aspect of the invention.

Smoking articles according to the present invention may conform to any size or dimensions known for smoking articles.

Alternatively, smoking articles according to the invention may comprise a coaxial core, comprising an inner core and outer annulus of smokeable materials, and wherein particles or fragments of acacia gum may be incorporated into either or both of the inner core or outer annulus. In such embodiments, the smoking article may comprise the same or different wrapper materials for the inner core and outer annulus.

Smoking articles typically comprise a filter at the mouth end, a rod which comprises smokeable material, and paper wrapped around the rod.

Smoking articles according to the present invention may comprise any filter configuration known in the art. Filters for smoking articles typically comprise one or more of fibrous cellulose acetate, polypropylene material, polyethylene material, or gathered paper material.

Referring to FIG. 1, a smoking article, 1, is illustrated comprising a filter, 2 and a substantially cylindrical tobacco rod, 3, aligned with the filter, 2, such that one end of the tobacco rod, 3, abuts the end of the filter. The tobacco rod, 3, has a cut away area to demonstrate the location of particles of acacia gum, 4. The tobacco rod, 3 is joined to the filter, 2, by tipping paper in a conventional manner.

According to a third aspect, there is provided the use of acacia gum in a smoking article to reduce the level of one or more of the constituents of mainstream smoke generated upon use of the smoking article. In some embodiments, reductions in mainstream smoke constituents may include, but are not restricted to, one or more of those substances known as Hoffmann analytes. The acacia gum may be in the form of particles or fragments.

The term 'Hoffmann analytes' is a term of art. It relates to a group of constituents of mainstream smoke generated from a smoking article, and includes aromatic amines; phenols; carbonyls; polycyclic aromatic hydrocarbons; acrylonitrile; volatile hydrocarbons such as isoprene, styrene and benzene; nitrogen heterocyclics such as pyridine; and TSNAs such as N'-nitrosoanabasine (NAB), N'-nitrosoanatabine (NAT), 4-(methylnitrosamino)-1-(3-pyridyl)-1-butanone (NNK) and N'-nitrosonornicotine (NNN); and inorganic compounds such as ammonia, hydrogen cyanide, nitric oxide and carbon monoxide.

In some embodiments according to the third aspect, the acacia gum is located within the tobacco rod, and may be applied to or incorporated into the smokeable material, as discussed in relation to the second aspect, above.

Without wishing to be bound by any theory, it is suggested that the effects resulting from incorporation of acacia gum into a smoking article arise from a change in the combustion and/or pyrolysis profile of the components of the smokeable material as a result of the presence of the acacia gum. This may be as a result of the physical presence of the acacia gum within the smokeable material, which exerts physicochemical effects on thermal processes within the combustion and/or pyrolysis zones, resulting in reductions of analytes which are generally nitrogen containing substances and phenolic substances. The observation that the reductions were greater than expected by reduction of NFDPM for many of the substances in mainstream smoke may indicate that synergistic effects could be occurring within the complex, dynamic combustion and/or pyrolysis processes occurring within the smoking article.

The following examples are provided to illustrate the present invention and should not be construed as limiting thereof.

Example 1

Acacia gum solution was spray dried and the resulting particles were further agglomerated using a fluidised bed drier utilising an aqueous binding solution of acacia gum (in the range 5-15%). The resulting agglomerated acacia gum particles were sieved using a cut off of up to 2000 μm. The average particle diameter was of the order of 800 μm.

Test cigarettes having smokeable material consisting of tobacco and agglomerated acacia gum particles, and comparative (control) cigarettes, having smokeable material consisting of tobacco only, were manufactured. Test and control cigarettes were made using the specifications and materials set out in Table A, below.

TABLE A

| | |
|---|---|
| Cigarette Dimensions | Length 83 mm, Circumference 24.6 mm |
| Paper | 50 Coresta |
| Filter | Cellulose acetate mono format 27 mm p.d. 85 mm W.G. |
| Blend | US style Blend (USB) |
| Tipping Paper | 32 mm |

Following manufacture of the control cigarettes, the machine used to make the cigarettes was adjusted in order to make the test cigarettes: the machine was adjusted so as to reduce the weight of tobacco incorporated into each test cigarette by approximately 50 mg, in order to allow room for the particles of acacia gum to be added. The acacia gum particles were added to the tobacco rod of the test cigarettes using apparatus as disclosed in WO 2011/033121, to give a particle loading of about 200 mg/cigarette (as tested by weight). As the loading of acacia gum particles was approximately 200 mg per cigarette, the resultant weight of the smokeable material for the test cigarettes was about 150 mg greater than the weight of the smokeable material for the control cigarettes.

A physical analysis of test and control cigarettes was carried out. Results are shown in FIG. 2.

Figure 4:
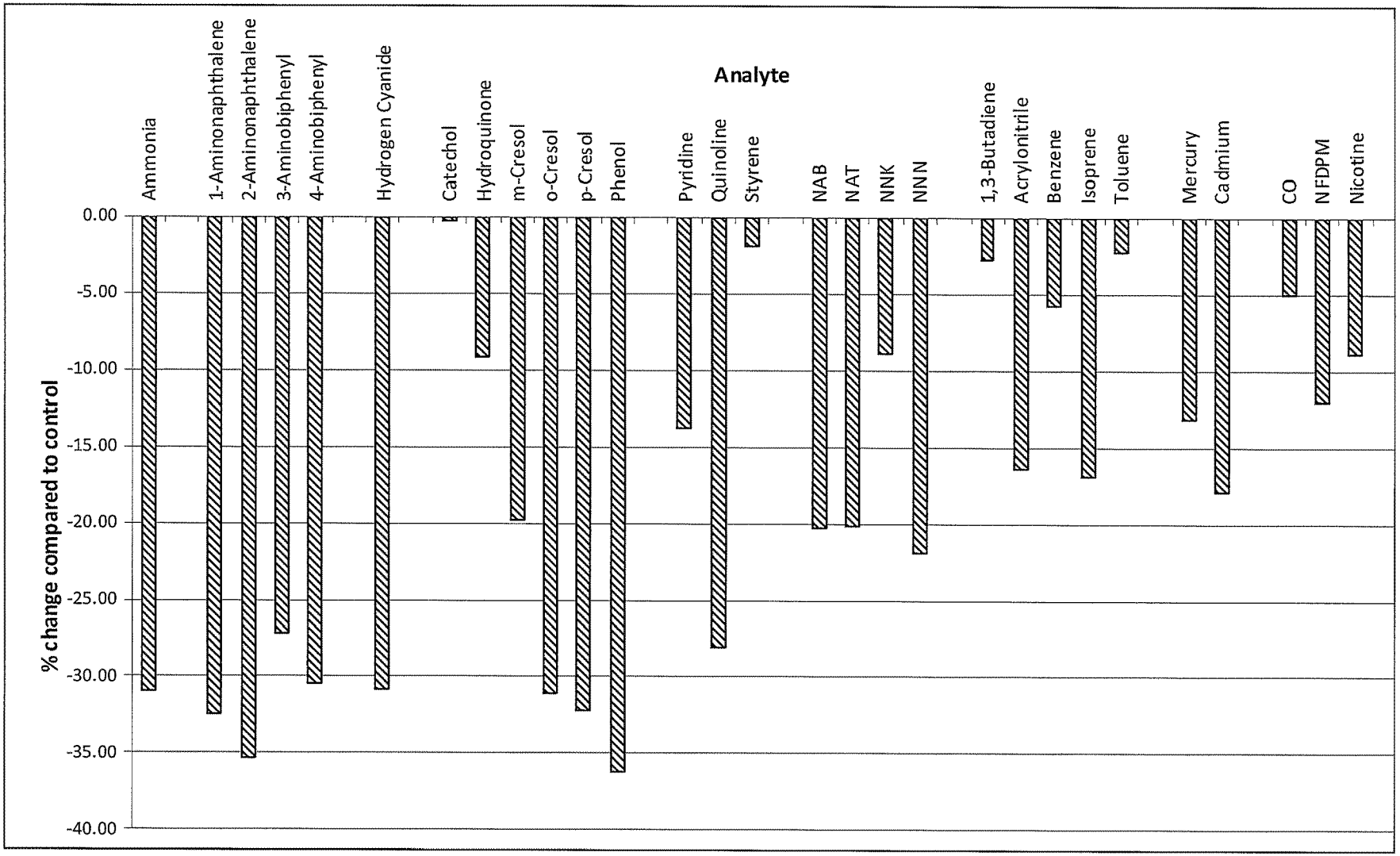
FIG. 4 is a graph demonstrating the reduction of certain analytes achieved by incorporating acacia gum into a smoking article. Details of the smoking regime used are shown in FIG. 3 (smoking regime 1).
Figure 6:
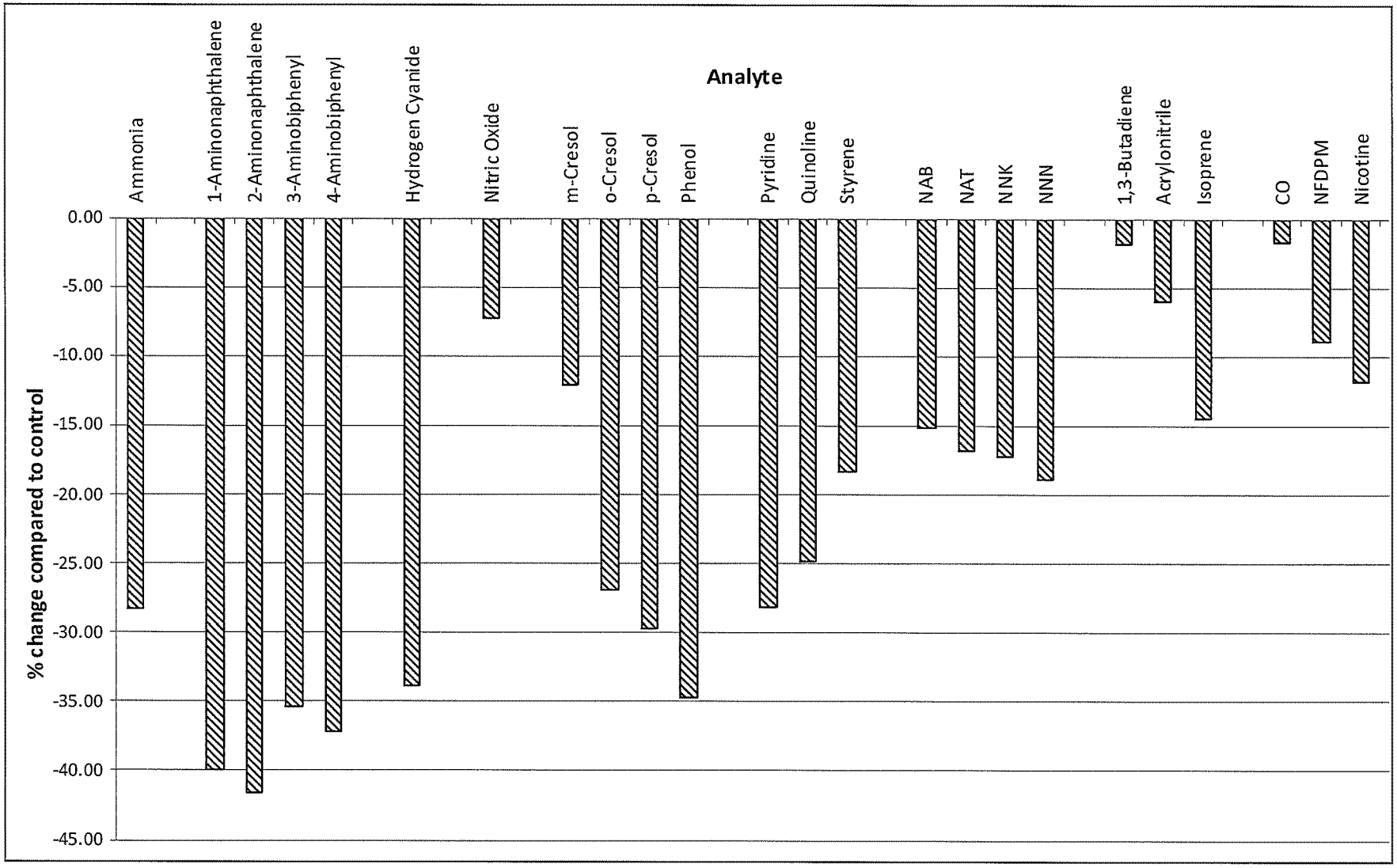
FIG. 6 is a graph demonstrating the reduction of certain analytes achieved by incorporating acacia gum into a smoking article. Details of the smoking regime used are shown in FIG. 3 (smoking regime 2).

Test and control cigarettes were then smoked using either smoking regime 1 or smoking regime 2, details of which are provided in FIG. 3, and the mainstream smoke from each cigarette was analysed. Results for smoking regime 1 are shown in FIG. 4 with the corresponding data provided in FIG. 5, and results for smoking regime 2 are shown in FIG. 6, with corresponding data provided in FIG. 7.

Under both smoking regimes cigarettes containing acacia gum particles reduced levels of certain components of mainstream smoke in comparison to control cigarettes. In particular, levels of ammonia, 1-aminonaphthalene, 2-aminonaphthalene, 3-aminobiphenyl and 4-aminobiphenyl, hydrogen cyanide, m-cresol, o-cresol, p-cresol, phenol, pyridine, quinoline and styrene, NAB, NAT, NNK, NNN, 1,3-butadiene, acrylonitrile and isoprene were reduced in comparison to control cigarettes.

Hydroquinone, mercury and cadmium were reduced in the mainstream smoke of test cigarettes smoked under smoking regime 1 in comparison to control cigarettes.

Some substances were reduced to a greater extent under smoking regime 2 in comparison to smoking regime 1, for example, styrene and NNK; whereas acrylonitrile was reduced to a greater extent under smoking regime 1 in comparison to smoking regime 2.

Furthermore, under both smoking regimes the observed reductions for several of these substances were greater than expected by reduction of NFDPM. For example, ammonia, 1-aminonapthalene, 2-aminonaphthalene, 3-aminbiphenyl, 4-aminobiphenyl, hydrogen cyanide, m-cresol, o-cresol, p-cresol, phenol, pyridine, quinoline, NAB, NAT, NNN, isoprene showed reductions in excess of that observed for NFDPM. In addition, styrene and NNK showed a greater reduction than NFDPM under smoking regime 2, and acrylonitrile showed a greater reduction than NFDPM for smoking regime 1.

Example 2

Particles of acacia gum with a coating of calcium alginate were created. Acacia gum solution was spray dried. The resultant dry material was agglomerated to increase particle size utilizing a solution of sodium alginate (in the range 2-10% in water). The resultant particles were further treated with a solution of calcium chloride in water (2-15%) causing an insoluble coating of calcium alginate to be formed. The resulting particles were sieved using a cut off of up to 2000 μm and the average particle diameter was in the order of 800 μm. Test cigarettes were manufactured using the resultant particles.

Similarly to Example 1, test cigarettes having a smokeable material consisting of tobacco and particles of coated acacia gum, and comparative (control) cigarettes, having smokeable material consisting of tobacco only, were manufactured.

Test and control cigarettes were manufactured using the specifications and materials set out in Table A, above.

Following manufacture of the control cigarettes, the machine used to make the cigarettes was adjusted so that the weight of tobacco incorporated into each test cigarette was reduced by approximately 50 mg, in order to allow room for the particles of coated acacia gum to be added. The coated acacia gum particles were then added to the tobacco rod of the test cigarettes using apparatus as disclosed in WO 2011/033121, to give a particle loading of about 210 mg/cigarette (as tested by weight). As the loading of coated acacia gum particles was approximately 210 mg per cigarette, the resultant weight of the smokeable material for the test cigarettes was about 160 mg greater than the weight of the smokeable material for the control cigarettes. A physical analysis of test and control cigarettes was carried out. Results are shown in FIG. 8.

Figures 9, 10:
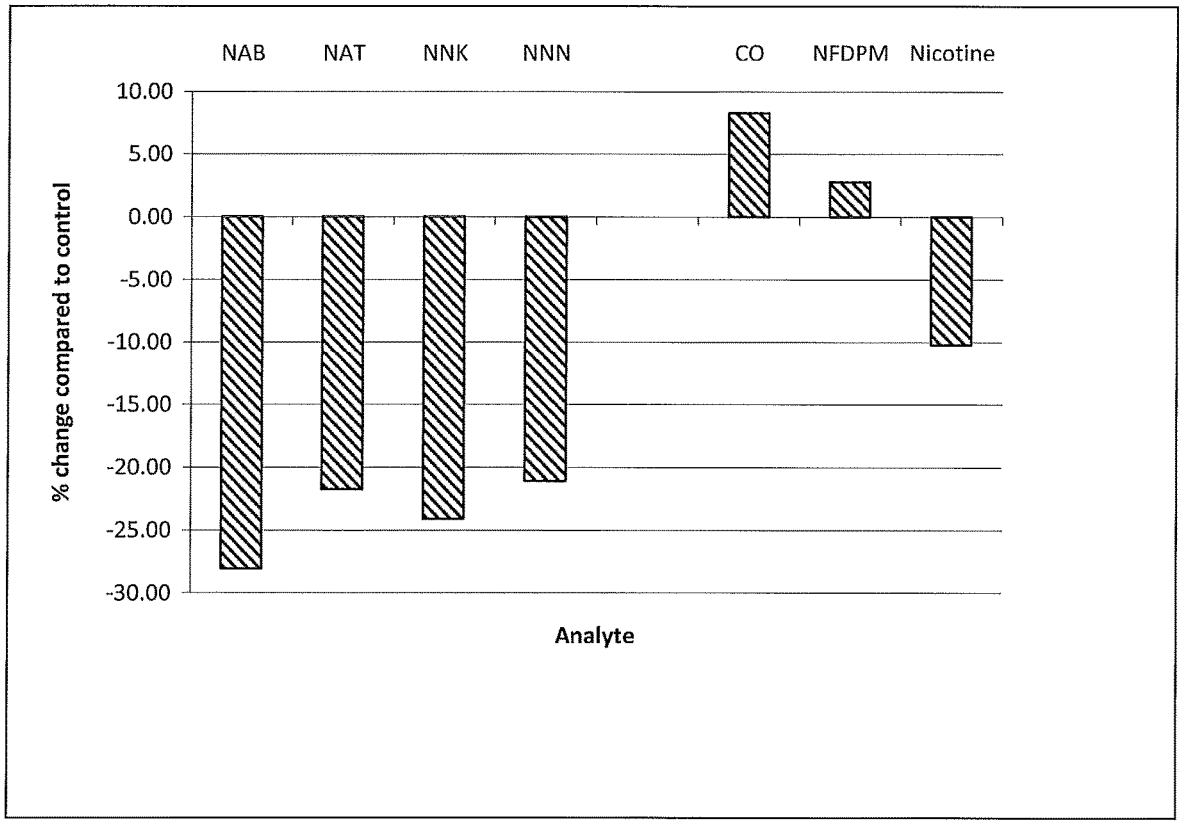
FIG. 9 is a graph demonstrating the reduction of tobacco specific nitrosamines (TSNAs) achieved by incorporating particles of acacia gum coated with calcium alginate into a smoking article. Details of the smoking regime used are shown in FIG. 3 (smoking regime 1).
FIG. 10 shows the tabulated data for FIG. 9.
Figures 11, 12:
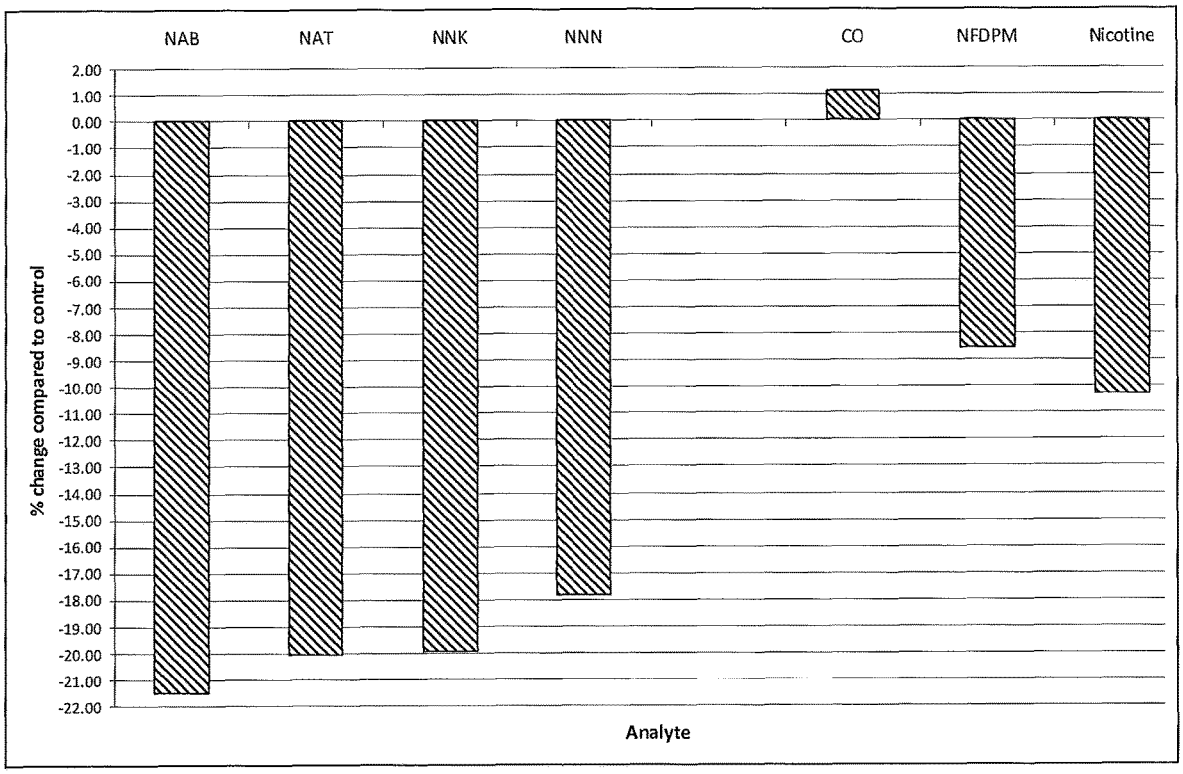
FIG. 11 is a graph demonstrating the reduction of TSNAs achieved by incorporating particles of acacia gum coated with calcium alginate into a smoking article. Details of the smoking regime used are shown in FIG. 3 (smoking regime 2).
FIG. 12 shows the tabulated data for FIG. 11.

Test and control cigarettes were then smoked using smoking regimes 1 and 2, details of which are provided in FIG. 3, and the mainstream smoke from each cigarette was analysed. Results for smoking regime 1 are shown in FIG. 9, with the corresponding data provided in FIG. 10. Results from smoking regime 2 are shown in FIG. 11, with the corresponding data provided in FIG. 12.

Under both smoking regimes cigarettes containing acacia gum particles coated with calcium alginate reduced levels of the TSNAs NAB, NAT, NNK and NNN in comparison to control cigarettes. The results also demonstrate that the TSNAs were reduced to a greater extent than the reduction achieved by NFDPM under both smoking regimes.

It would therefore appear that a coating of calcium alginate does not adversely affect the ability of the acacia gum particles to reduce the levels of TSNAs in mainstream smoke in comparison to control cigarettes.

In order to address various issues and advance the art, the entirety of this disclosure shows, by way of illustration, various embodiments in which the claimed invention may be practiced and provide for a superior process for preparing material for inclusion in the smokeable material of a smoking article comprising particle or fragments comprising acacia gum and not comprising a diluent, flavourant or aerosol generating material. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A smokeable material for inclusion in a smoking article, the smokeable material comprising particles or fragments comprising acacia gum, wherein the particles or fragments: (a) do not comprise a diluent, flavourant, aerosol generating material or one or more aerogels, cryogels, or xerogels; and (b) comprise acacia gum, wherein the particles or fragments are between 0.5 mm and 2 mm in diameter; and wherein the smokeable material comprises tobacco.

2. A smokeable material as claimed in claim 1, wherein the particles or fragments further comprise a coating.

3. A smokeable material as claimed in claim 2, wherein the coating comprises calcium alginate.

4. A smoking article comprising a smokeable material according to claim 3.

5. A smokeable material as claimed in claim 1, wherein the particles or fragments are formed prior to their application to or incorporation into components of the smokeable material, wherein the smokeable material further comprises one or more of tobacco substitutes, filler material, diluents, binders, humectants, flavour or flavourants or aerosol generating material.

6. A smokeable material as claimed in claim 1, wherein the particles or fragments are formed upon, or subsequent to application to or incorporation into components of the smokeable material, wherein the smokeable material further comprises one or more of tobacco substitutes, filler material, diluents, binders, humectants, flavour or flavourants or aerosol generating material.

7. A smokeable material as claimed in claim 1, wherein the smokeable material further comprises one or more of tobacco substitutes, filler material, diluents, binders, humectants, flavour or flavourants or aerosol generating material.

8. A smokeable material as claimed in claim 1, wherein the particles or fragments comprising acacia gum are applied to or incorporated into the smokeable material in an amount between 10 mg and 675 mg per 750 mg smokeable material; or between 50 mg and 300 mg per 750 mg smokeable material.

9. A smokeable material as claimed in claim 8, wherein the particles or fragments comprising acacia gum are applied to or incorporated into the smokeable material in an amount of 150, 160, 170, 180, 190, 200, 210, 220 or 230 mg per 750 mg smokeable material.

10. A smoking article comprising a smokeable material according to claim 1.

11. A smokeable material as recited in claim 1, wherein the particles or fragments:

do not comprise a catalyst.

12. A smokeable material as claimed in claim 1, wherein the particles or fragments are between 0.6 mm and 1.8 mm in diameter.

13. A smokeable material as claimed in claim 1, wherein the particles or fragments are between 0.7 mm and 1 mm in diameter.

14. A smokeable material as claimed in claim 1, wherein the particles or fragments are 0.8 mm in diameter.

15. A method of manufacturing a smoking article, the method comprising mixing particles or fragments of acacia gum with tobacco and then incorporating the mixture comprising the tobacco and particles or fragments of acacia gum into a smoking article, wherein the particles or fragments:

(a) do not comprise a diluent, flavourant, aerosol generating material or one or more aerogels, cryogels, or xerogels; and (b) comprise acacia gum, wherein the particles or fragments are between 0.5 mm and 2 mm in diameter.

16. The method of manufacturing a smoking article as recited in claim 15, wherein the particles or fragments:

do not comprise a catalyst.

17. The method of manufacturing a smoking article as recited in claim 15, wherein the particles or fragments consist of acacia gum.

18. A method of reducing a level of one or more constituents of mainstream smoke, the method including the following steps:

providing a smoking article having a smokeable material and acacia gum, generating mainstream smoke from the smoking article, and the acacia gum decreasing the level of one or more of the constituents of mainstream smoke, wherein the acacia gum is in the form of particles or fragments, wherein the particles or fragments: (a) do not comprise a diluent, flavourant, aerosol generating material or one or more aerogels, cryogels, or xerogels; and (b) comprise acacia gum, wherein the particles or fragments are between 0.5 mm and 2 mm in diameter.

19. The method recited in claim 18, wherein the acacia gum is located within a tobacco rod of the smoking article.

20. The method recited in claim 19, wherein the acacia gum is applied to or incorporated into the smokeable material within the tobacco rod.

21. The method recited in claim 18, wherein the particles or fragments:

do not comprise a catalyst.

22. The method recited in claim 18, wherein the particles or fragments consist of acacia gum.

* * * * *